US007620543B2

(12) United States Patent
Kim et al.

(10) Patent No.: US 7,620,543 B2
(45) Date of Patent: Nov. 17, 2009

(54) METHOD, MEDIUM, AND APPARATUS FOR CONVERTING AUDIO DATA

(75) Inventors: Dohyung Kim, Gyeonggi-do (KR); Sangwook Kim, Seoul (KR); Ennmi Oh, Seoul (KR); Junghoe Kim, Seoul (KR); Yangseock Seo, Gyeonggi-do (KR); Shihwa Lee, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 819 days.

(21) Appl. No.: 11/033,733

(22) Filed: Jan. 13, 2005

(65) Prior Publication Data

US 2005/0180586 A1 Aug. 18, 2005

(30) Foreign Application Priority Data

Jan. 13, 2004 (KR) ..... 10-2004-0002249

(51) Int. Cl.
*G10L 19/00* (2006.01)

(52) U.S. Cl. ..... 704/200.1; 704/500; 704/229; 704/230; 375/240.03

(58) Field of Classification Search ..... 704/229, 704/230, 500–504, 200.1; 375/240.03; 381/22
See application file for complete search history.

(56) References Cited

U.S. PATENT DOCUMENTS 6,263,022 B1 * 7/2001 Chen et al. ..... 375/240.03
6,349,284 B1 * 2/2002 Park et al. ..... 704/500
6,456,963 B1 * 9/2002 Araki ..... 704/200.1
6,529,604 B1 * 3/2003 Park et al. ..... 381/22
6,639,943 B1 * 10/2003 Radha et al. ..... 375/240.11
6,792,044 B2 * 9/2004 Peng et al. ..... 375/240.03
6,931,060 B1 * 8/2005 Jiang et al. ..... 375/240.03
7,200,561 B2 * 4/2007 Moriya et al. ..... 704/500
7,277,849 B2 * 10/2007 Streich et al. ..... 704/229
7,318,035 B2 * 1/2008 Andersen et al. ..... 704/500
7,343,287 B2 * 3/2008 Geiger et al. ..... 704/230
2003/0014241 A1 1/2003 Ferris et al.
2005/0010395 A1 * 1/2005 Chiu et al. ..... 704/200.1
2005/0010396 A1 * 1/2005 Chiu et al. ..... 704/200.1

FOREIGN PATENT DOCUMENTS

CN 1126265 10/2003
EP 0918407 5/1999
WO 03/096326 11/2003

OTHER PUBLICATIONS

Chi-Min Liu, Wen-Wei Chang; "Audio Coding Standards", 1999, pp. 1-27, Taiwan University.

(Continued)

*Primary Examiner*—Vijay B Chawan
(74) *Attorney, Agent, or Firm*—Staas & Halsey LLP

(57) ABSTRACT

A method, medium, and apparatus for converting compressed audio data, including decoding compressed audio input data, in accordance with a corresponding compression format, coding a result of the decoding, in accordance with a predetermined compression format, and combining a result of the coding with the side information to generate audio output data to be compressed according to the predetermined compression format.

35 Claims, 8 Drawing Sheets

OTHER PUBLICATIONS

Bosi et al., "ISO/IEC MPEG-2 Advanced Audio Coding", Oct. 1997, pp. 789-812, Journal of the Audio Engineering Society, Audio Engineering Society, New York, NY, vol. 45, No. 10.

Hans et al., "An MPEG Audio Layered Transcoder", Sep. 1998, pp. 1-18, Preprints of Papers Presented at the AES Convention.

European Search Report mailed Jun. 23, 2006.

Chinese Office Action dated Apr. 10, 2009, issued in corresponding Chinese Application No. 2005100044674.

* cited by examiner

FIG. 3

| Syntax | No. of bits | Mnemonic |
|---|---|---|
| channel_pair_element() | | |
| { | | |
| **element_instance_tag;** | **4** | **uimsbf** |
| | | |
| **common_window;** | **1** | **uimsbf** |
| if (common_window) { | | |
| ics_info(); | | |
| **ms_mask_present;** | **2** | **uimsbf** |
| if ( ms_mask_present == 1 ) { | | |
| for (g = 0; g < num_window_groups; g++) { | | |
| for (sfb = 0; sfb < max_sfb; sfb++) { | | |
| **ms_used[g][sfb];** | **1** | **uimsbf** |
| } | | |
| } | | |
| } | | |
| } | | |
| individual_channel_stream(common_window,0); | | |
| individual_channel_stream(common_window,0); | | |
| } | | |

FIG. 4

| Syntax | No. of bits | Mnemonic |
|---|---|---|
| general_header() | | |
| { | | |
| **reserved_bit;** | **1** | **bslbf** |
| **window_sequence;** | **2** | **uimsbf** |
| **window_shape;** | **1** | **uimsbf** |
| if (window_sequence == EIGHT_SHORT_SEQUENCE) { | | |
| **max_sfb;** | **4** | **uimsbf** |
| **scale_factor_grouping;** | **7** | **uimsbf** |
| } else { | | |
| **max_sfb;** | **6** | **uimsbf** |
| } | | |
| | | |
| **pns_data_present;** | **1** | **uimbf** |
| if (pns_data_present) | | |
| **pns_start_sfb;** | **6** | **uimbf** |
| | | |
| if (nch == 2) | | |
| **ms_mask_present;** | **2** | **bslbf** |
| | | |
| for (ch = 0 ch < nch; ch++) { | | |
| **tns_data_present[ch];** | **1** | **bslbf** |
| if (tns_data_present[ch]) | | |
| tns_data(); | | |
| | | |
| **ltp_data_present[ch];** | **1** | **bslbf** |
| if (ltp_data_present[ch]) | | |
| ltp_data(last_max_sfb, max_sfb); | | |
| } | | |
| } | | |

METHOD, MEDIUM, AND APPARATUS FOR CONVERTING AUDIO DATA

CROSS-REFERENCE TO RELATED APPLICATIONS

This application claims the benefit of Korean Patent Application No. 2004-2249, filed on Jan. 13, 2004, in the Korean Intellectual Property Office, the disclosure of which is incorporated herein in its entirety by reference.

BACKGROUND OF THE INVENTION

1. Field of the Invention

The present invention relates to audio data processing, and more particularly, to a method and apparatus for converting audio data compressed in a predetermined format into audio data compressed in another format.

2. Description of the Related Art

MPEG-2 layer 3 or MPEG-1 layer 3 (also known as MP3) audio devices are being gradually replaced by MPEG-4 devices with high compression efficiency. MPEG-4 is being adopted by many digital service operators such as the European digital audio broadcasting (DAB) system, in order to process video and audio signals. In particular, a bit sliced arithmetic coding (BSAC) format rather than an advanced audio coding (AAC) format is used in audio signal processing. On the other hand, an AACPlus format that combines a spectral band replication (SBR) technology with an AAC format is also used as an audio signal processing technology in satellite digital multimedia broadcasting.

Further, contents including audio data compressed in an AAC format or a BSAC format have been widely used in the audio multimedia market. With this in mind, it is very important to provide multimedia services continuously to suit a user's taste or environment. In particular, since a plurality of devices are incorporated in a user's computing environment and various content formats are used worldwide, demands for multimedia services that suit a user's taste or environment have been further increased. Here, an environment can mean a network or content formats which a user uses. Multimedia kernel technologies for providing services suitable for a variety of environments to the user include scalability and conversion methods. In the scalability method, data is made to be suitable for a variety of environments. In the conversion method, audio data compressed in one format is converted into audio data to be compressed in another format.

In general, in the conversion method, audio input data compressed in a predetermined format is fully decoded to generate pulse coding modulation (PCM) data, and the PCM data is then fully coded in a desired compression format. Accordingly, a decoding unit is conventionally needed to fully decode audio input data, and a separate coding unit is needed to fully code data in a desired format. Accordingly, the conversion method is expensive and time-consuming.

SUMMARY OF THE INVENTION

Embodiments of the present invention set forth a method of converting audio data by which audio input data compressed in a first format is simply converted into audio output data to be compressed in another format based on whether part of side information of right and left channels, within the compressed audio input data, is shared.

Embodiments of the present invention also set forth an apparatus for converting audio data in which audio input data compressed in a predetermined format is simply converted into audio output data to be compressed in another format based on whether part of side information of right and left channels is shared.

Additional aspects and/or advantages of the invention will be set forth in part in the description which follows and, in part, will be obvious from the description, or may be learned by practice of the invention.

To achieve the above and/or other aspects and advantages, embodiments of the present invention include a method of converting compressed audio data, the method including decoding compressed audio input data, in accordance with a corresponding compression format, coding a result of the decoding, in accordance with a predetermined compression format, and combining a result of the coding with the side information to generate audio output data to be compressed according to the predetermined compression format.

The decoding of audio input data may further include obtaining the side information from the compressed audio input data, and decoding the compressed audio input data, except for the side information, in accordance with the corresponding compression format, as quantizatized data, wherein the coding may further include coding the quantized data in accordance with the predetermined compression format and combining the result of coding with the obtained side information to generate the audio output data.

In addition, the decoding of audio input data may further include at least one of inverse quantizing the quantized data; stereo processing a result of the inverse quantizing; temporal noise shaping (TNS) processing a result of the stereo processing; and converting data in a frequency domain, resulting from the TNS processing, into time domain data. In addition, the coding of quantized data may further include at least one of: converting the time domain data into new data in the frequency domain; TNS processing the new data in the frequency domain; stereo processing a result of the TNS processing of the new data in the frequency domain; and quantizing a result of the stereo processing of the result of the TNS processing of the new data in the frequency domain. The decoding of audio input data may further include the inverse quantizing, the stereo processing of the result of the inverse quantizing, the temporal noise shaping, and/or the converting of the data in the frequency domain to the time domain, the coding of quantized data respectively includes the converting of the time domain data into new data in the frequency domain, the TNS processing of the new data in the frequency domain, the stereo processing of the result of the TNS processing of the new data in the frequency domain, and/or the quantizing of the result of the stereo processing of the result of the TNS processing of the new data in the frequency domain.

In addition, the quantizing of the result of the stereo processing of the result of the TNS processing of the new data in the frequency domain, quantization noise is minimized using information contained in the side information obtained from the audio input data, similar to a masking threshold value.

Further, the method may be particularly performed when part of side information of right and left channels, of the compressed input audio data, is shared. The method may be particularly performed when any part of side information of right and left channels, of the compressed input audio data, is not shared. In addition, the decoded results may be coded using only side information of one channel of the right and left channels. Similarly, the method may be particularly performed for each audio data frame from a previous frame of a current frame until a frame in which part of corresponding side information of the right and left channels is shared, and/or the method may be particularly performed for each audio data frame from a current frame until a frame in which part of corresponding side information of the right and left channels is shared.

In addition, the corresponding compression format in which the audio input data is compressed may be a bit sliced arithmetic coding (BSAC) format, and the predetermined compression format is an advanced audio coding (AAC) format. Alternatively, the corresponding compression format in which the audio input data is compressed may be an advanced audio coding (AAC) format, the predetermined compression format may be a bit sliced arithmetic coding (BSAC) format, and the advanced audio coding (AAC) format shares part of side information of corresponding right and left channels of the compressed input audio data. Similarly, the corresponding compression format in which the audio input data is compressed may be an advanced audio coding (AAC) format, the predetermined compression format is a bit sliced arithmetic coding (BSAC) format, and the advanced audio coding (AAC) format does not share any part of side information of corresponding the right and left channels of the compressed input audio data. The standard to which the AAC format belongs may be one of an MPEG-2 standard or MPEG-4 standard, or the standard to which the BSAC format belongs may be an MPEG-4 standard.

Similar to above, the method may further include determining whether part of side information of right and left channels of the compressed input audio data is shared, and wherein if it is determined that any part of side information of right and left channels, of the compressed input audio data, is not shared, the decoding of the compressed audio input data further includes at least one of an inverse quantizing, a stereo processing of a result of the inverse quantizing, a temporal noise shaping, and a converting of data resulting from the temporal noise shaping in a frequency domain into time domain data, and the coding of the result of the decoding further includes at least one of a converting of the time domain data into new data in the frequency domain, a TNS processing of the new data in the frequency domain, a stereo processing of a result of the TNS processing of the new data in the frequency domain, and a quantizing of a result of the stereo processing of the result of the TNS processing of the new data in the frequency domain.

To achieve the above and/or other aspects and advantages, embodiments of the present invention set forth an apparatus for converting compressed audio data, the apparatus including a decoding unit decoding compressed audio input data, in accordance with a corresponding compression format, and a coding unit coding a result of the decoding in accordance with a predetermined compression format and combining the side information with the a result of the coding to generate audio output data to be compressed according to the predetermined compression format.

The decoding unit may include a data unpacking portion obtaining the side information from the compressed audio input data, and a decoding portion decoding the compressed audio input data, except for the side information, in accordance with the corresponding compression format as quantized data, wherein the coding unit may further include a coding portion coding the quantized data in accordance with the predetermined compression format, and a data combination portion combining the result of coding with the obtained side information to generate the audio output data.

In addition, the decoding unit may further include at least one of an inverse quantization portion inverse quantizing the quantized data, a first stereo processing portion stereo processing a result of the inverse quantized portion, a first temporal noise shaping (TNS) portion TNS processing a result of the first stereo processed portion, and a first domain conversion portion converting a result of the first TNS processing, in a frequency domain, into time domain data, wherein the coding unit further include at least one of a second domain conversion portion converting the time domain data into frequency domain data, a second TNS portion TNS processing the frequency domain data, a second stereo processing portion stereo processing a result of the second TNS portion, and a quantization portion quantizing a result of the second stereo processing portion, wherein the coding portion codes a result of the quantizing portion in accordance with the predetermined compression format, and when the decoding portion comprises the first domain conversion portion, the first TNS portion, the first stereo processing portion and/or the inverse quantization portion, the coding unit respectively comprises the second domain conversion portion, the second TNS portion, the second stereo processing portion, and/or the quantization portion.

The quantization portion may minimize quantization noise using information contained in the side information, similar to a masking threshold value.

Similar to above, the apparatus may particularly operate when part of side information of right and left channels, of the compressed input audio data, is shared, and the apparatus may particularly operate when any part of the side information of right and left channels, of the compressed input audio data, is not shared. The coding unit may code the result of the decoding using only side information of one channel of the right and left channels. The apparatus may particularly operate from a previous frame of a current frame until a frame in which part of side information of corresponding right and left channels is shared, and/or the apparatus may particularly operate from a current frame until a frame in which part of side information of corresponding right and left channels is shared.

Again, similar to above, the apparatus may include a checking unit determining whether part of side information of right and left channels of the compressed input audio data is shared and outputting a result of the determinating, wherein in response to the determination result, an inverse quantization portion, a first stereo processing portion, a first TNS portion, a first domain conversion portion, a second domain conversion portion, a second TNS portion, a second stereo processing portion, and a quantization portion operate.

In addition, methods of the present invention may include a reviewing of a common window field within the side information to identify if part of side information for left and right channels, of the compressed input audio data, are shared. Similarly, apparatuses of the present invention may include a data unpacking portion obtaining the side information from the compressed audio input data, including a common window field within the side information to identify if part of side information for left and right channels, of the compressed input audio data, are shared.

To achieve the above and/or other aspects and advantages, embodiments of the present invention include a method of converting compressed audio data, the method including decoding compressed audio input data, in accordance with a corresponding compression format, and coding a result of the decoding, in accordance with a predetermined compression format and based on a sharing aspect between differing corresponding side information for right and left channels of the compressed audio input data, wherein the decoding and/or the coding are based on a sharing aspect between differing corresponding side information for right and left channels of the compressed audio input data.

The method may be particularly performed for each audio data frame from at least a current frame until a frame in which part of the corresponding side information of the right and left channels is shared. In addition, the method may further include the combining of a result of the coding with the side information to generate audio output data to be compressed according to the predetermined compression format.

To achieve the above and/or other aspects and advantages, embodiments of the present invention include an apparatus for converting compressed audio data, the apparatus include a decoding unit decoding compressed audio input data, in accordance with a corresponding compression, and a coding unit coding a result of the decoding in accordance with a predetermined compression format, wherein the decoding unit and/or the coding unit perform the decoding and/or the coding based on a sharing aspect between differing corresponding side information for right and left channels of the compressed audio input data.

To achieve the above and/or other aspects and advantages, embodiments of the present invention include a medium including computer readable code implementing embodiments of the present invention.

BRIEF DESCRIPTION OF THE DRAWINGS

These and/or other aspects and advantages of the invention will become apparent and more readily appreciated from the following description of the embodiments, taken in conjunction with the accompanying drawings of which:

FIG. 3 illustrates an example of a structure of audio data compressed in an AAC format;

FIG. 4 illustrates an example of a structure of audio data compressed in a BSAC format;

DETAILED DESCRIPTION OF THE PREFERRED EMBODIMENTS

Figure 1:
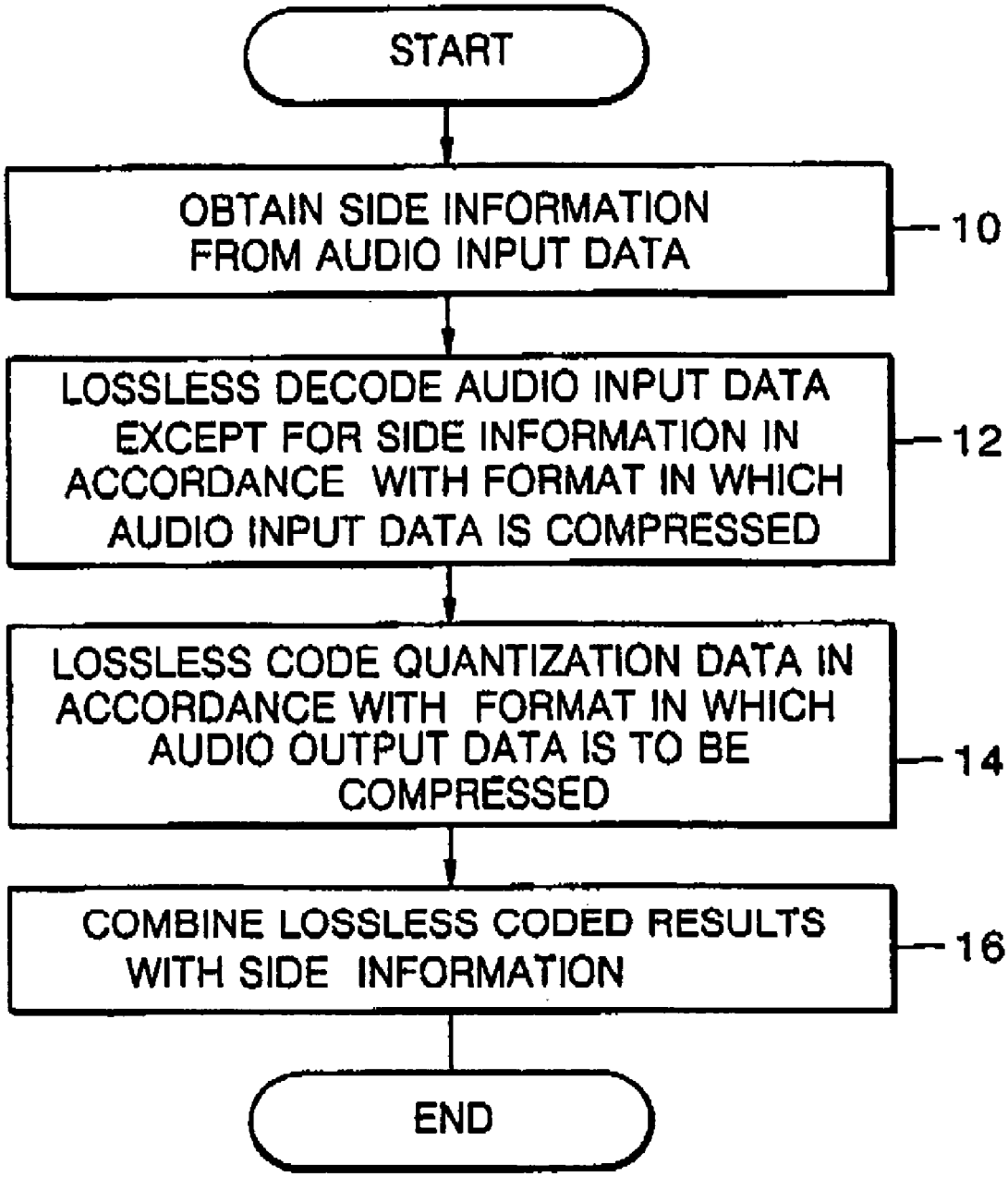
FIG. 1 is a flowchart illustrating a method of converting audio data, according to an embodiment of the present invention.

Reference will now be made in detail to embodiments of the present invention, examples of which are illustrated in the accompanying drawings, wherein like reference numerals refer to the like elements throughout. The embodiments are described below to explain the present invention by referring to the figures.

FIG. 1 is a flowchart illustrating a method of converting audio data, according to an embodiment of the present invention. This method of converting audio data includes decoding audio input data (operations 10 and 12) and obtaining audio output data by coding the decoded results (operations 14 and 16).

According to this embodiment, in operations 10 and 12, audio input data is losslessly decoded in accordance with a compression format in which the audio input data is compressed.

For example, in operation 10, side information is first obtained from the compressed audio input data. When the audio data is decoded portions of this side information can similarly be broken down, as detailed above in the background, where the conventional conversion method required audio data compressed in one format to be completely decoded into PCM data and then fully coded into another compression format. Conversely, as will detailed herein, embodiments of the present invention can use this side information to help streamline the conversion process such that the audio data is not required to be completely decoded to the PCM data and then fully coded into the other compression format.

The obtained side information may include 1-bit window_shape information, 2-bit window_sequence information, 4- or 6-bit max_sfb information, or 7-bit scale_factor_grouping information. Here, the window_shape information is information additionally identifying one among window coefficients as having a sine format or a Kaiser-Bessel derived (KBD) format. The window_sequence information is information that represents whether the type of a window used in processing one frame is a long, start, short, or stop type. The max_sfb information is information, determined according to the window_sequence information, representing a maximum of effective scalefactor bands. The scale_factor_grouping information is information, existing only when the window_sequence information is short, representing how to group eight windows.

After operation 10, in operation 12, the audio input data, except for the side information, is losslessly decoded in accordance with the corresponding compression format. Here, the lossless decoded results may be quantized data.

After operation 12, in operations 14 and 16, the quantized data is losslessly coded in accordance with a desired compression format. For example, in operation 14, the quantized data is losslessly coded in accordance with the desired compression format. After operation 14, in operation 16, the lossless coded results and the obtained side information are combined with each other, with combined results becoming the audio output data.

Figure 2:
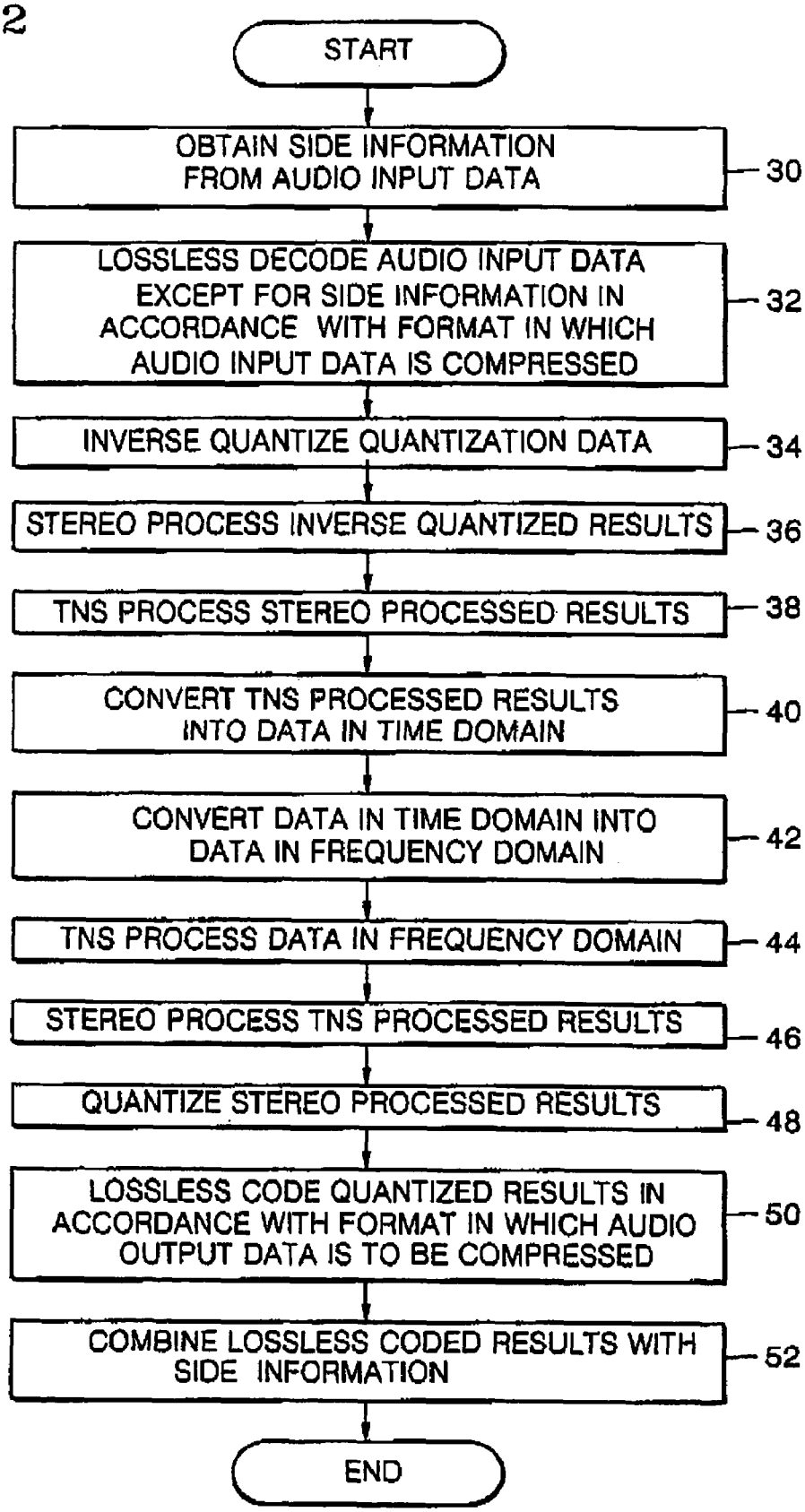
FIG. 2 is a flowchart illustrating a method of converting audio data, according to another embodiment of the present invention.

FIG. 2 is a flowchart illustrating a method of converting audio data, according to another embodiment of the present invention. This method of converting audio data includes decoding audio input data (operations 30 through 40) and obtaining audio output data by coding decoded results (operations 42 through 52).

According to this embodiment, in operations 30 through 40, audio input data is losslessly decoded in accordance with a corresponding compression format. Operations 30 and 32 of FIG. 2 may correspond to operations 10 and 12 of FIG. 1, respectively, and perform similar operations, and thus, detailed descriptions thereof will be omitted.

After operation 32, in operation 34, quantized data is inverse quantized. After operation 34, in operation 36, the inverse quantized results are stereo processed. For example, the inverse quantized results may be processed using a mid/additional (M/S) stereo or an intensity stereo, etc. After operation 36, in operation 38, the stereo processed results are temporal noise shaping (TNS) processed. After operation 38, in operation 40, data in the frequency domain (as the TNS processed results) is converted into data in the time domain.

After operation 40, in operations 42 through 52, the data in the time domain is losslessly coded in accordance with a desired compression format. For example, after operation 40, in operation 42, the data in the time domain is converted into data in the frequency domain. After operation 42, in operation 44, the data in the frequency domain is TNS processed. Here, TNS processing adjusts quantization noise, in advance, using a prediction technique. After operation 44, in operation 46, the TNS processed results are stereo processed. After operation 46, in operation 48, stereo processed results are then quantized. In this case, in operation 48, quantization noise can be minimized using information similar to a masking threshold value, for example, a scalefactor. Here, the information similar to the masking threshold value can be a value, not the masking threshold value, but obtained from the masking threshold value. The information similar to the masking threshold value may be contained in the side information obtained from the audio input data. After operation 48, in operation 50, quantized results are then losslessly coded in accordance with the desired compression format. After operation 50, in operation 52, lossless coded results and the obtained side information are combined with each other, with the combined results becoming the audio output data.

The method of converting audio data of FIG. 2 may further include at least one of operations 34 through 40. In this case, when the method of converting audio data includes operations 40, 38, 36, and 34, operations 42, 44, 46, and 48 may be respectively included in the method of converting audio data. For example, when the method of converting audio data includes operation 34, operation 48 may be included in the method of converting audio data, and when the method of converting audio data includes operation 36, operation 46 may be included in the method of converting audio data. In addition, when the method of converting audio data includes operation 38, operation 44 may be included in the method of converting audio data, and when the method of converting audio data includes operation 40, operation 42 may be included in the method of converting audio data, for example.

Meanwhile, a bit sliced arithmetic coding (BSAC) format, an advanced audio coding (AAC) format, or a Twin-VQ format may be used as the compression formats in which the audio input data is compressed, or the desired compression format in which the audio output data is to be compressed. In this case, Huffman coding is used in the AAC format, and arithmetic coding is used in the BSAC format. For example, when the format in which the audio input data is compressed is the BSAC format and the format in which the audio output data is to be compressed is the AAC format, in operation 12 of FIG. 1, lossless decoding is performed using arithmetic coding, and in operation 14 of FIG. 1, lossless coding is performed using Huffman method, for example.

In general, right and left channels have similar characteristics. As detailed above, part of the side information of right and left channels can be shared. However, in a particular case, part of the side information of the right and left channels may not be shared. When the compression format of the audio input data or the desired compression format for the audio output data is the BSAC format, part of the side information of the right and left channels is shared. However, when the compression format in which the audio input data is compressed or the desired compression format for the audio output data is the AAC format, part of the side information of the right and left channels may or may not be shared.

FIG. 3 illustrates an example of a structure of audio input data compressed in an AAC format, or audio output data to be compressed in the AAC format. FIG. 4 illustrates an example of a structure of audio input data compressed in a BSAC format or audio output data to be compressed in the BSAC format.

As shown in FIG. 3, the audio input data compressed in the AAC format, or the audio output data to be compressed in the AAC format, has a 1-bit variable common_window in "channel pair element ( )". Here, the variable common_window identifies whether part of the side information of right and left channel is shared when audio data is stereo.

When the variable common_window is '0', any part of the side information of the right and left channels is not shared. For example, when the variable common_window is '0', any one of window_shape information, window_sequence information, max_sfb information, or scale_factor_grouping information is not shared. However, when the variable common_window is '1', part of the side information of the right and left channels is shared. For example, when the variable common_window is '1', at least one of the window_shape information, the window_sequence information, the max_sfb information, and the scale_factor_grouping information is shared.

Contrary to this, referring to FIG. 4, the audio input data compressed in the BSAC format, or the audio output data to be compressed in the BSAC format, does not have the variable common_window, and part of the side information of the right and left channels is always shared.

When part of the side information of the right and left channels is shared, the audio input data can be converted into the audio output data using the method of converting audio data of FIG. 1, instead of FIG. 2. For example, when the compression format of the audio input data is an MPEG-4 BSAC format, and the compression format for the audio output data is an MPEG-2 or MPEG-4 AAC format, the method of converting audio data of FIG. 1 can be used. Alternatively, when the compression format of the audio input data is the AAC format, which shares part of the side information of the right and left channels, and the compression format for the audio output data is the BSAC format, the method of converting audio data of FIG. 1 can also be similarly used.

On the other hand, when any part of the side information of the right and left channels is not shared, the audio input data is converted into the audio output data using the method of converting audio data of FIG. 2, instead of FIG. 1. In this case, when decoded results are coded in operations 42 through 52, of FIG. 2, either the side information of the left channel or the side information of the right channel is used. In this case, the use of the side information of the left channel or the side information of the right channel may be determined according to the use purpose of side information. For example, when window_sequence in the side information of the left channel is long and window_sequence in the side information of right channel is short, the use of the side information of the left channel or the side information of the right channel is determined based on the use purpose of side information. Here, even though any side information is determined, the case where the variable common_window is '1' based on the entire frame is rare. Thus, the kind of determined side information has little effect on the method of converting audio data, according to embodiments of the present invention. For example, when the compression format of the audio input data is the MPEG-2 or MPEG-4 AAC format, where any part of the side information of the right and left channels is not shared, and the compression format for the audio output data is the MPEG-4 BSAC format, the audio input data can still be converted into the audio output data using the method of converting audio data of FIG. 2.

Meanwhile, whether part of the side information of the right and left channels is shared may be determined according to each separate frame. Thus, the appropriate method for converting audio data, i.e., that of FIG. 1 or 2, may be differently applied to separate frames.

According to an embodiment of the present invention, the method of converting audio data of FIG. 2 may be performed from a current frame until a frame where part of the side information of the right and left channels is shared.

According to another embodiment of the present invention, the method of converting audio data of FIG. 2 may be performed from a previous frame of the current frame until a frame where part of the side information of the right and left channels is shared. The main reason why the side information of the left channel is different from the side information of the right channel is that the window_sequence information of the left channel is different from that of the right channel. That is, one channel of the right and left channels uses a long window, and the other channel thereof uses a short window. In this case, since the audio input data processed using the long window cannot immediately be converted into the audio output data processed using the short window, in general, the audio input data processed using the long window is converted into the audio output data processed using a start window, and then, the audio input data processed using the start window is converted into the audio output data processed using the short window. Thus, the audio input data may be converted into the audio output data in consideration of a previous frame, because of overlap and add features in which half of the previous frame and half of the current frame are overlapped and processed and which appear when inverse modified discrete cosine transform (IMDCT) is performed.

First, as shown in Table 1, it can be assumed that the audio input data is compressed in the AAC format, having a different bit in each frame, and is converted into the audio output data compressed in the BSAC format.

TABLE 1

| | Classifications | | | | | |
|---|---|---|---|---|---|---|
| Channels | Frame 1 | Frame 2 | Frame 3 | Frame 4 | Frame 5 | Frame 6 |
| Right channel | 0 | 0 | 0 | 0 | 0 | 0 |
| Left channel | 0 | 1 | 2 | 3 | 0 | 0 |

As shown in Table 1, it is assumed that a variable common_window in a frame 1 is '1', a variable common_window from a frame 2 to a frame 4 is '0'and a variable common_ window from a frame 5 to a frame 6 is '1'.

Based on these assumption, according to an embodiment of the present invention, the method of converting audio data of FIG. 1 may be applied to a previous frame (frame 1), and the method of converting audio data of FIG. 2 may be applied from the current frame (frame 2), to a frame (frame 5) where part of the side information of the right and left channels is shared, that is, to a frame (frame 4).

According to another embodiment of the present invention, even though the method of converting audio data of FIG. 1 can be applied to the previous frame (frame 1), the method of converting audio data of FIG. 2 may be applied from the previous frame (frame 1) of the current frame (frame 2), to a frame (frame 5) where part of the side information of the right and left channels is shared, that is, a frame (frame 4), when converting the current frame (frame 2).

Figure 5:
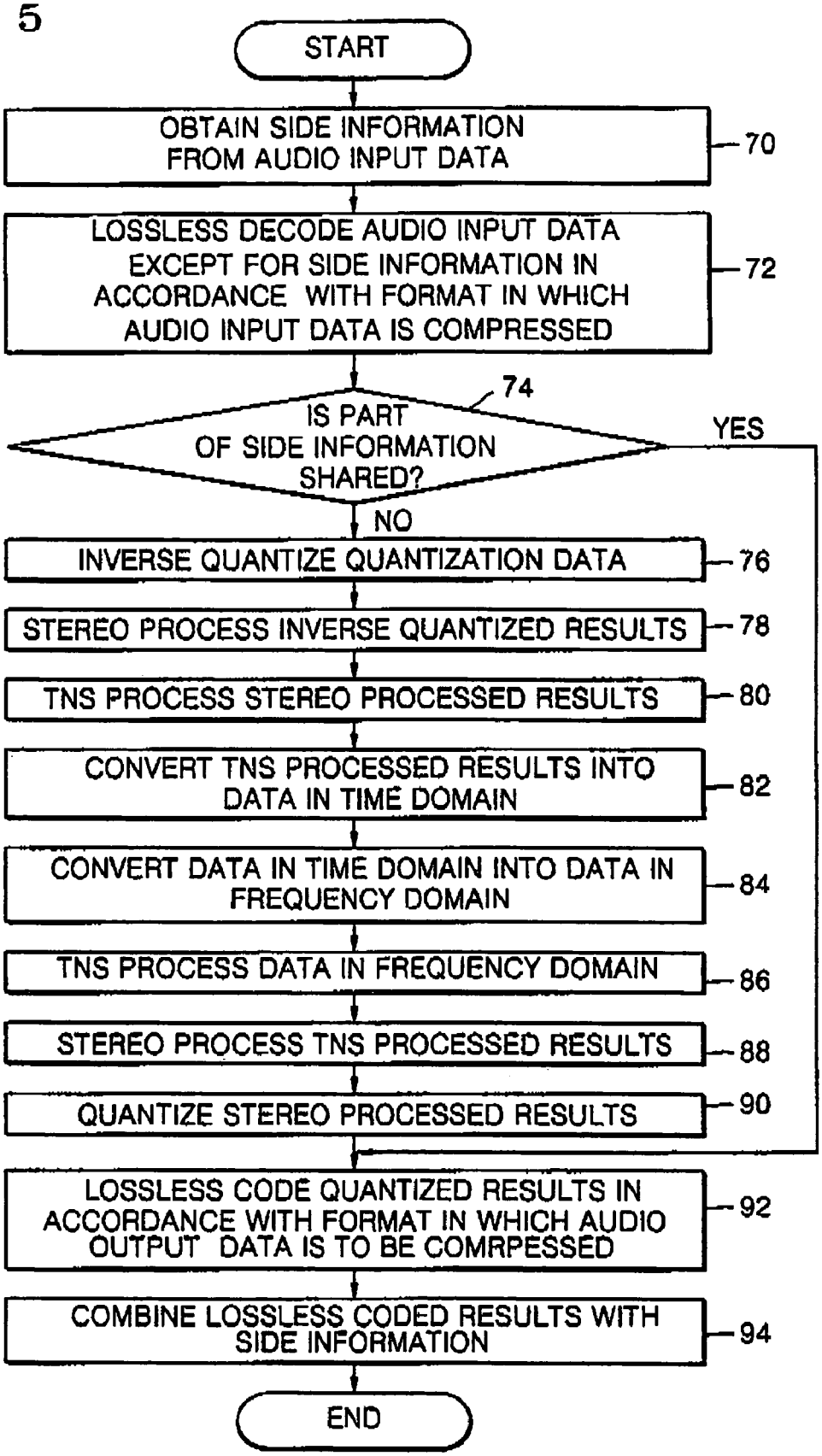
FIG. 5 is a flowchart illustrating a method of converting audio data, according to still another embodiment of the present invention.

FIG. 5 is a flowchart illustrating a method of converting audio data according to still another embodiment of the present invention. The method of converting audio data of FIG. 5 includes decoding audio input data (operations 70 through 82) and obtaining audio output data by coding decoded results (operations 84 through 94).

Operations 70 and 72 of FIG. 5 can correspond to operations 30 and 32 of FIG. 2, respectively, and performs similar operations, and thus, detailed descriptions thereof will be omitted. In addition, operations 76 through 94 of FIG. 5 may correspond to operations 34 through 52 of FIG. 2, respectively, and performs similar operations, and thus, detailed descriptions thereof will also be further omitted. Consequently, the method of converting audio data of FIG. 5 is similar to the method of converting audio data of FIG. 2, except that the method of FIG. 5 at least further includes operation 74.

According to this embodiment of the present invention, in operation 74, it is determined whether part of the side information of right and left channels is shared.

If it is determined that any part of the side information of the right and left channels is not shared, the method proceeds to operation 76. In this case, in the method of converting audio data of FIG. 5, similar to the method of converting audio data of FIG. 2, operations 76 through 94 are performed to generate converted audio output data. In this case, the method of converting audio data of FIG. 5 may further include at least one of operations 76, 78, 80, and 82, similar to the method of converting audio data of FIG. 2. In this case, when the method of converting audio data of FIG. 5 includes operations 76, 78, 80, and 82, operations 90, 88, 86, and 84 may be further included in the method of converting audio data of FIG. 5.

However, if it is determined that part of the side information of the right and left channels is shared, the method proceeds to operation 92. In this case, in the method of converting audio data of FIG. 5, similar to the method of converting audio data of FIG. 1, operations 14 and 16 can be performed to generate converted audio output data.

Hereinafter, an apparatus for converting audio data, according to another embodiment of the present invention will be described in detail with reference to the attached drawings.

Figure 6:
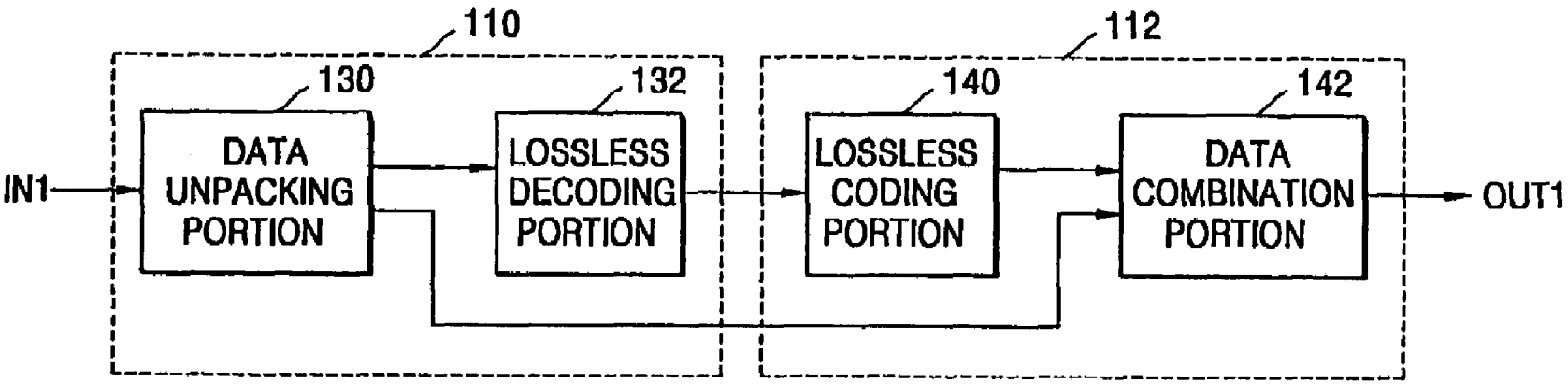
FIG. 6 is a block diagram of an apparatus for converting audio data, according to an embodiment of the present invention.

FIG. 6 is a block diagram of an apparatus for converting audio data, according to an embodiment of the present invention. The apparatus for converting audio data of FIG. 6 includes a decoding unit 110 and a coding unit 112.

The decoding unit 110 losslessly decodes audio input data, in accordance with a compression format of audio input data, input through an input terminal IN1, and outputs lossless decoded results to the coding unit 112.

In this case, the coding unit 112 losslessly codes the lossless decoded results, in accordance with a desired compression format for the audio output data, and outputs lossless coded results to an output terminal OUT1.

According to this embodiment of the present invention, the decoding unit 110 and the coding unit 112 may be implemented as shown in FIG. 6. That is, the decoding unit 110 may include a data unpacking portion 130 and a lossless decoding portion 132, and the coding unit 112 may include a lossless coding portion 140 and a data combination portion 142. In this case, the apparatus for converting audio data of FIG. 6 may also perform the method of converting audio data similar to FIG. 1, for example.

In order to perform operation 10, the data unpacking portion 130 obtains side information by unpacking the audio input data having a bit stream pattern, input through the input terminal IN1, outputs the obtained side information to the data combination portion 142, and outputs the audio input data excluding the side information to the lossless decoding portion 132.

In order to perform operation 12, the lossless decoding portion 132 inputs the audio input data, except for the side information, from the data unpacking portion 130, losslessly decodes the audio input data, except for the side information, and in accordance with the corresponding compression format, and outputs lossless decoded results as quanitization data. For example, when the compressed format of the audio input data is a bit sliced arithmetic coding (BSAC) format, the lossless decoding portion 132 performs lossless decoding using an arithmetic method. However, when the compressed format of the audio input data is an advanced audio coding (AAC) format, the lossless decoding portion 132 performs lossless decoding using a Huffman method.

In order to perform operation 14, the lossless coding portion 140 losslessly codes the quantized data input from the lossless decoding portion 132, in accordance with a desired compresssion format, and outputs lossless coded results to the data combination portion 142. For example, when the desired compression format is a BSAC format, the lossless coding portion 140 performs lossless coding using arithmetic coding. However, when the desired compression format is an AAC format, the lossless coding portion 140 performs lossless coding using Huffman coding.

In order to perform operation 16, the data combination portion 142 combines the lossless coded results obtained by the lossless coding portion 140 with the side information input from the data unpacking portion 130 and outputs the combined results as the audio output data to an output terminal OUT1.

Figure 7:
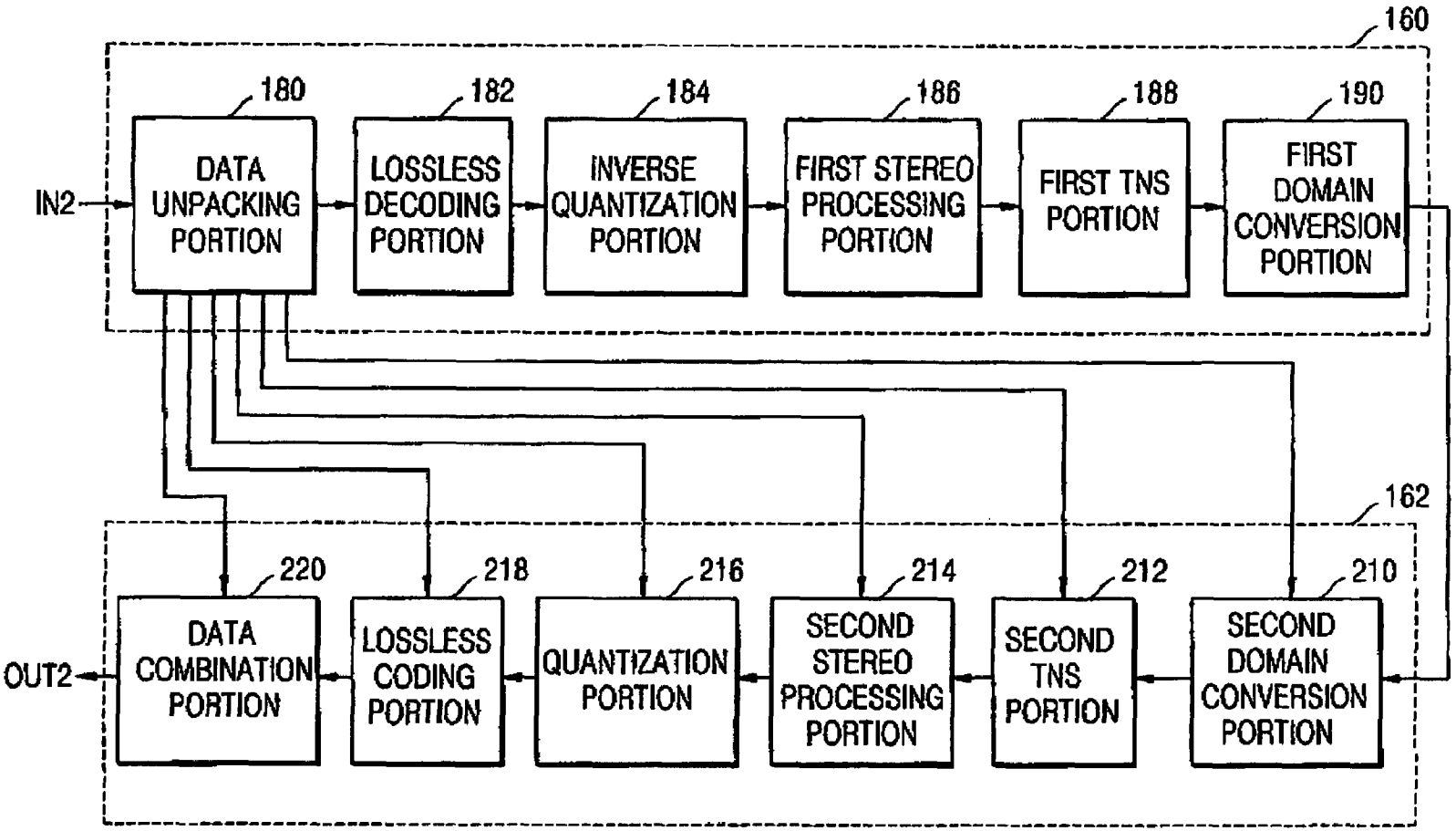
FIG. 7 is a block diagram of an apparatus for converting audio data, according to another embodiment of the present invention.

FIG. 7 is a block diagram of an apparatus for converting audio data, according to another embodiment of the present invention. The apparatus of FIG. 7 includes a decoding unit 160 and a coding unit 162. The decoding unit 160 and the coding unit 162 of FIG. 7 perform similar respective operations as those of the decoding unit 110 and the coding unit 112 of FIG. 6.

According to this embodiment, as shown in FIG. 7, the decoding unit 160 may include a data unpacking portion 180, a lossless decoding portion 182, an inverse quantization portion 184, a first stereo processing portion 186, a first temporal noise shaping (TNS) portion 188, and a first domain conversion portion 190. In addition, the coding unit 162 may include a second domain conversion portion 210, a second TNS portion 212, a second stereo processing portion 214, a quantization portion 216, a lossless coding portion 218, and a data combination portion 220. In this case, the apparatus for converting audio data of FIG. 7 may perform similar to the method of converting audio data of FIG. 2, for example.

The data unpacking portion 180 and the lossless decoding portion 182 of FIG. 7, which respectively perform operations 30 and 32 of FIG. 2, for example, perform similar operations as those of the data unpacking portion 130 and the lossless decoding portion 132 of FIG. 6, and thus, detailed descriptions thereof will be omitted.

In order to perform operation 34, the inverse quantization portion 184 inverse quantizes the quantized data output from the lossless decoding portion 182 and outputs inverse quantized results to the first stereo processing portion 186.

In order to perform operation 36, the first stereo processing portion 186 stereo processes the inverse quantized results obtained by the inverse quantization portion 184 and outputs stereo processed results to the first TNS portion 188.

In order to perform operation 38, the first TNS portion 188 TNS processes the stereo processed results obtained by the first stereo processing portion 186 and outputs TNS processed results to the first domain conversion portion 190.

In order to perform operation 40, the first domain conversion portion 190 converts data in the frequency domain, as the TNS processed results obtained by the first TNS portion 188, into data in the time domain and outputs the data in the time domain to the coding unit 162.

In order to perform operation 42, the second domain conversion portion 210 converts the data in the time domain, input from the first domain conversion portion 190, into data in the frequency domain and outputs the converted data in the frequency domain to the second TNS portion 212.

In order to perform operation 44, the second TNS portion 212 TNS processes the data in the frequency domain, input from the second domain conversion portion 210, and outputs TNS processed results to the second stereo processing portion 214.

In order to perform operation 46, the second stereo processing portion 214 stereo processes the TNS processed results, obtained by the second TNS portion 212, and outputs stereo processed results to the quantization portion 216.

In order to perform operation 48, the quantization portion 216 quantizes the stereo processed results of the second stereo processing portion 214 and outputs quantized results to the lossless coding portion 218. In this case, the quantization portion 216 can minimize quantization noise using information, contained in the obtained side information input from the data unpacking portion 180, and similar to a masking threshold value. In a conventional conversion method, a separate auditory psychological sound modeling unit, which calculates a masking threshold value from the side information contained in the audio input data, would be provided, and quantization noise would be minimized using the calculated masking threshold value. Thus, due to the conventionally required separate auditory psychological sound modeling unit, costs increase.

In order to perform operation 50, the lossless coding portion 218 losslessly codes the quantized results, obtained by the quantization portion 216, in accordance with the desired compression format and outputs lossless coded results to the data combination portion 220.

In order to perform operation 52, the data combination portion 220 combines the lossless coded results with the side information input from the data unpacking portion 180 and outputs combined results as the audio output data to an output terminal OUT2.

The coding unit 162 of FIG. 7 codes the decoded results obtained by the decoding unit 160 using only side information of one channel of right and left channels. For example, the second domain conversion portion 210, the second TNS portion 212, the second stereo processing portion 214, the quantization portion 216, the lossless coding portion 218, and the data combination portion 220 of the coding unit 162, which input the side information output from the data unpacking portion 180, perform coding using only side information of one channel of right and left channels.

The decoding unit 160 of FIG. 7 may include at least one of the inverse quantization portion 184, the first stereo processing portion 186, the first TNS portion 188, and the first domain conversion portion 190. Similarly, the coding unit 162 may include at least one of the second domain conversion portion 210, the second TNS portion 212, the second stereo processing portion 214, and the quantization portion 216. If the decoding unit 160 of FIG. 7 includes the first domain conversion portion 190, the first TNS portion 188, the first stereo processing portion 186, and the inverse quantization portion 184, the coding unit 162 may include the second domain conversion portion 210, the second TNS portion 212, the second stereo processing portion 214, and the quantization portion 216.

The apparatus for converting audio data of FIG. 6 can be used when part of the side information of the right and left channels is shared, and the apparatus for converting audio data of FIG. 7 can be used when any part of the side information of the right and left channels is not shared.

Meanwhile, whether part of the side information of the right and left channels is shared may be determined differently for each frame. Thus, the apparatus for converting audio data of FIG. 6 or 7 may be alternatively applied to each frame.

Here, the apparatus for converting audio data of FIG. 7 may be applied from the previous frame, of a current frame, until a frame in which part of the side information of the right and left channels is shared, to convert the audio input data into the audio output data. Alternatively, the apparatus for converting audio data of FIG. 7 may be applied from the current frame until a frame in which part of the side information of the right and left channels is shared, to convert the audio input data into the audio output data.

Figure 8:
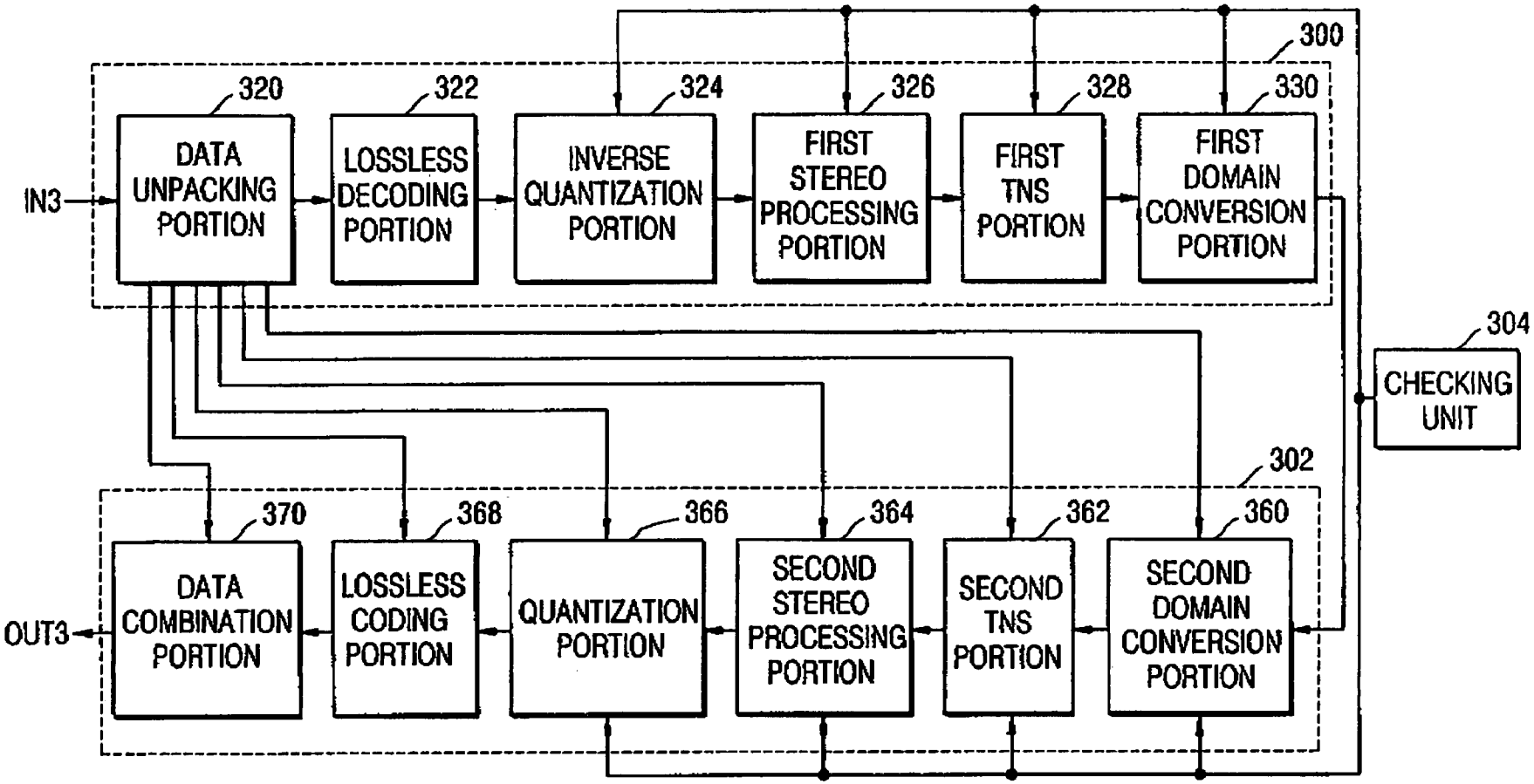
FIG. 8 is a block diagram of an apparatus for converting audio data, according to still another embodiment of the present invention.

FIG. 8 is a block diagram of an apparatus for converting audio data, according to still another embodiment of the present invention. The apparatus for converting audio data of FIG. 8 includes a decoding unit 300, a coding unit 302, and a checking unit 304.

The decoding unit 300 and the coding unit 302 of FIG. 8 perform similar operations as those of the decoding unit 110 and the coding unit 112 of FIG. 6.

According to this embodiment of the present invention, as shown in FIG. 8, the decoding unit 300 may include a data unpacking portion 320, a lossless decoding portion 322, an inverse quantization portion 324, a first stereo processing portion 326, a first temporal noise shaping (TNS) portion 328, and a first domain conversion portion 330. In addition, the coding unit 302 may include a second domain conversion portion 360, a second TNS portion 362, a second stereo processing portion 364, a quantization portion 366, a lossless coding portion 368, and a data combination portion 370. In this case, the apparatus for converting audio data of FIG. 8 may similarly perform the method of converting audio data of FIG. 5.

The apparatus for converting audio data of FIG. 8 is similar to the apparatus for converting audio data of FIG. 7, except that the apparatus of FIG. 8 further includes a checking unit 304 and each of the decoding unit 300 and the coding unit 302 are operated using checked results of the checking unit 304. Thus, only a difference between the apparatus for converting audio data of FIG. 8 and the apparatus for converting audio data of FIG. 7 will now be described.

In order to perform operation 74, the checking unit 304 checks whether part of side information of right and left channels is shared, and outputs checking results to each of the decoding unit 300 and the coding unit 302. In this case, if it is recognized in response to checked results of the checking unit 304, that is, from the checked results, that part of the side information of the right and left channels is shared, the inverse quantization portion 324, the first stereo processing portion 326, the first temporal noise shaping (TNS) portion 328, the first domain conversion portion 330, the second domain conversion portion 360, the second TNS portion 362, the second stereo processing portion 364, and the quantization portion 366 may operate.

As described above, in methods and apparatuses for converting audio data according to embodiments of the present invention, when part of side information of right and left channels is shared, full decoding and full coding are not performed, and as shown in FIG. 1 or 6, audio input data is simply converted into audio output data. Thus, costs are reduced and conversion speeds increases. Even when any part of the side information of the right and left channels is not shared, as shown in FIGS. 2, 5, 7 or 8, the audio input data is simply converted into the audio output data, compared to the conventional conversion method, where a separate auditory psychological sound modeling unit (not shown) is required. Thus, costs are reduced and a conversion speed increases. Accordingly, multimedia services are seamlessly provided to suit a user's taste or environment in various applications, and the user can use fast and various content formats when using an advanced audio coding (AAC) format and a bit sliced arithmetic coding (BSAC) format together for compression of audio data. For example, in a home network environment, when digital broadcasting received from outside a home is transmitted to a device inside the home, e.g., via a home gateway, audio input data can be easily converted into audio output data to suit a compression format of a receiving device such that desired services are seamlessly provided to any device inside the home.

In addition to the above described embodiments, embodiments of the present invention can also be implemented through computer readable code and implemented in general-use digital computers through use of a computer readable medium including the computer readable code. The computer readable medium can correspond to any medium/media permitting the storing or transmission of the computer readable code.

This computer readable code can be recorded/transferred on a computer readable medium in a variety of ways. Examples of the computer readable medium may include magnetic storage media (e.g., ROM, floppy disks, hard disks, etc.), and optical recording media (e.g., CD-ROMs, or DVDs).

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A method of converting compressed audio data, the method comprising:

decoding compressed audio input data, in accordance with a corresponding compression format;

obtaining quantized data from a result of the decoding, the obtaining being respectively different based on whether a part of side information of right and left channels of the compressed audio input data is shared;

coding the quantized data, in accordance with a predetermined compression format; and combining a result of the coding with the side information to generate audio output data to be compressed according to the predetermined compression format.

2. The method of claim 1, wherein the decoding of audio input data comprises:

obtaining the side information from the compressed audio input data; and decoding the compressed audio input data, except for the side information, in accordance with the corresponding compression format, as the quantized data, wherein the coding further comprises:

coding the quantized data in accordance with the predetermined compression format; and combining the result of coding with the obtained side information to generate the audio output data.

3. The method of claim 2, wherein the decoding of audio input data further comprises at least one of:

inverse quantizing the quantized data;

stereo processing a result of the inverse quantizing;

temporal noise shaping (TNS) processing a result of the stereo processing; and converting data in a frequency domain, resulting from the TNS processing, into time domain data, wherein the coding of quantized data further comprises at least one of:

converting the time domain data into new data in the frequency domain;

TNS processing the new data in the frequency domain;

stereo processing a result of the TNS processing of the new data in the frequency domain; and quantizing a result of the stereo processing of the result of the TNS processing of the new data in the frequency domain, wherein when the decoding of audio input data includes the inverse quantizing, the stereo processing of the result of the inverse quantizing, the temporal noise shaping, and/or the converting of the data in the frequency domain to the time domain, the coding of quantized data respectively includes the converting of the time domain data into new data in the frequency domain, the TNS processing of the new data in the frequency domain, the stereo processing of the result of the TNS processing of the new data in the frequency domain, and/or the quantizing of the result of the stereo processing of the result of the TNS processing of the new data in the frequency domain.

4. The method of claim 3, wherein in the quantizing of the result of the stereo processing of the result of the TNS processing of the new data in the frequency domain, quantization noise is minimized using information contained in the side information obtained from the audio input data, similar to a masking threshold value.

5. The method of claim 3, wherein the method is particularly performed when any part of side information of right and left channels, of the compressed input audio data, is not shared.

6. The method of claim 5, wherein the decoded results are coded using only side information of one channel of the right and left channels.

7. The method of claim 5, wherein the method is particularly performed for each audio data frame from a previous frame of a current frame until a frame in which part of corresponding side information of the right and left channels is shared.

8. The method of claim 5, wherein the method is particularly performed for each audio data frame from a current frame until a frame in which part of corresponding side information of the right and left channels is shared.

9. The method of claim 3, wherein the corresponding compression format in which the audio input data is compressed is an advanced audio coding (AAC) format, the predetermined compression format is a bit sliced arithmetic coding (BSAC) format, and the advanced audio coding (AAC) format does not share any part of side information of corresponding the right and left channels of the compressed input audio data.

10. The method of claim 2, wherein the method is particularly performed when part of side information of right and left channels, of the compressed input audio data, is shared.

11. The method of claim 2, wherein the corresponding compression format in which the audio input data is compressed is a bit sliced arithmetic coding (BSAC) format, and the predetermined compression format is an advanced audio coding (AAC) format.

12. The method of claim 2, wherein the corresponding compression format in which the audio input data is compressed is an advanced audio coding (AAC) format, the predetermined compression format is a bit sliced arithmetic coding (BSAC) format, and the advanced audio coding (AAC) format shares part of side information of corresponding right and left channels of the compressed input audio data.

13. The method of claim 12, wherein a standard to which the AAC format belongs is one of an MPEG-2 standard or MPEG-4 standard.

14. The method of claim 12, wherein a standard to which the BSAC format belongs is an MPEG-4 standard.

15. The method of claim 2, further comprising determining whether part of side information of right and left channels of the compressed input audio data is shared, wherein if it is determined that any part of side information of right and left channels, of the compressed input audio data, is not shared, the decoding of the compressed audio input data further includes at least one of an inverse quantizing, a stereo processing of a result of the inverse quantizing, a temporal noise shaping, and a converting of data resulting from the temporal noise shaping in a frequency domain into time domain data, and the coding of the result of the decoding further includes at least one of a converting of the time domain data into new data in the frequency domain, a TNS processing of the new data in the frequency domain, a stereo processing of a result of the TNS processing of the new data in the frequency domain, and a quantizing of a result of the stereo processing of the result of the TNS processing of the new data in the frequency domain.

16. The method of claim 1, further comprising reviewing a common window field within the side information to identify if part of side information for left and right channels, of the compressed input audio data, are shared.

17. A computer readable medium storing computer readable code that when executed by a processor causes a computer to execute the method of claim 1.

18. An apparatus for converting compressed audio data, the apparatus comprising:

a decoding unit decoding compressed audio input data, in accordance with a corresponding compression format; and a coding unit obtaining quantized data from a result of the decoding, the obtaining being respectively different based on whether a part of side information of right and left channels, of the compressed audio input data is shared, coding the quantized data in accordance with a predetermined compression format and combining the side information with a result of the coding to generate audio output data to be compressed according to the predetermined compression format.

19. The apparatus of claim 18, wherein the decoding unit comprises:

a data unpacking portion obtaining the side information from the compressed audio input data; and a decoding portion decoding the compressed audio input data, except for the side information, in accordance with the corresponding compression format as quantized data, wherein the coding unit further comprises:

a coding portion coding the quantized data in accordance with the predetermined compression format; and a data combination portion combining the result of coding with the obtained side information to generate the audio output data.

20. The apparatus of claim 19, wherein the decoding unit further comprises at least one of:

an inverse quantization portion inverse quantizing the quantized data a first stereo processing portion stereo processing a result of the inverse quantized portion;

a first temporal noise shaping (TNS) portion TNS processing a result of the first stereo processed portion; and a first domain conversion portion converting a result of the first TNS processing, in a frequency domain, into time domain data, wherein the coding unit further comprises at least one of:

a second domain conversion portion converting the time domain data into frequency domain data;

a second TNS portion TNS processing the frequency domain data;

a second stereo processing portion stereo processing a result of the second TNS portion; and a quantization portion quantizing a result of the second stereo processing portion, wherein the coding portion codes a result of the quantizing portion in accordance with the predetermined compression format, and when the decoding portion comprises the first domain conversion portion, the first TNS portion, the first stereo processing portion and/or the inverse quantization portion, the coding unit respectively comprises the second domain conversion portion, the second TNS portion, the second stereo processing portion, and/or the quantization portion.

21. The apparatus of claim 20, wherein the quantization portion minimizes quantization noise using information contained in the side information, similar to a masking threshold value.

22. The apparatus of claim 20, wherein the apparatus particularly operates when any part of the side information of right and left channels, of the compressed input audio data, is not shared.

23. The apparatus of claim 22, wherein the coding unit codes the result of the decoding using only side information of one channel of the right and left channels.

24. The apparatus of claim 22, wherein the apparatus operating on each frame particularly operates from a previous frame of a current frame until a frame in which part of side information of corresponding right and left channels is shared.

25. The apparatus of claim 22, wherein the apparatus operating on each frame particularly operates from a current frame until a frame in which part of side information of corresponding right and left channels is shared.

26. The apparatus of claim 19, wherein the apparatus particularly operates when part of side information of right and left channels, of the compressed input audio data, is shared.

27. The apparatus of claim 18, further comprising a checking unit determining whether part of side information of right and left channels of the compressed input audio data is shared and outputting a result of the determining, wherein in response to the determination result, an inverse quantization portion, a first stereo processing portion, a first TNS portion, a first domain conversion portion, a second domain conversion portion, a second TNS portion, a second stereo processing portion, and a quantization portion operate.

28. The apparatus of claim 18, further comprising a data unpacking portion obtaining the side information from the compressed audio input data, including a common window field within the side information to identify if part of side information for left and right channels, of the compressed input audio data, are shared.

29. A method of converting compressed audio data, the method comprising:

decoding compressed audio input data, in accordance with a corresponding compression format; and coding a result of the decoding, in accordance with a predetermined compression format and, wherein the decoding and/or the coding are based on a sharing aspect between differing corresponding side information for right and left channels of the compressed audio input data.

30. The method of claim 29, wherein the method is particularly performed for each audio data frame at least from a current frame until a frame in which part of the corresponding side information of the right and left channels is shared.

31. The method of claim 29, further comprising:

combining a result of the coding with the side information to generate audio output data to be compressed according to the predetermined compression format.

32. A computer readable medium storing computer readable code that when executed by a processor causes a computer to execute the method of claim 29.

33. An apparatus for converting compressed audio data, the apparatus comprising:

a decoding unit decoding compressed audio input data, in accordance with a corresponding compression format; and a coding unit coding a result of the decoding in accordance with a predetermined compression format, wherein the decoding unit and/or the coding unit perform the decoding and/or the coding based on a detected sharing aspect between differing corresponding side information for right and left channels of the compressed audio input data.

34. The apparatus of claim 33, wherein the apparatus particularly operates on each audio data frame at least from a current frame until a frame in which part of the corresponding side information of the right and left channels is shared.

35. The apparatus of claim 33, wherein the coding unit further combines the side information with a result of the coding to generate audio output data to be compressed according to the predetermined compression format.

* * * * *

UNITED STATES PATENT AND TRADEMARK OFFICE

CERTIFICATE OF CORRECTION

PATENT NO. : 7,620,543 B2
APPLICATION NO. : 11/033733
DATED : November 17, 2009
INVENTOR(S) : Dohyung Kim et al.

It is certified that error appears in the above-identified patent and that said Letters Patent is hereby corrected as shown below:

Column 17, Line 7, after "data" insert --;--.

Signed and Sealed this

Second Day of February, 2010

David J. Kappos

David J. Kappos
*Director of the United States Patent and Trademark Office*